United States Patent [19]

Auerbach

[11] 4,380,210

[45] Apr. 19, 1983

[54] WORKPIECE MOISTENING SYSTEM

[75] Inventor: David R. Auerbach, Georgetown, Conn.

[73] Assignee: Pitney Bowes Inc., Stamford, Conn.

[21] Appl. No.: 332,627

[22] Filed: Dec. 21, 1981

[51] Int. Cl.[3] ..... B05C 1/06

[52] U.S. Cl. ..... 118/253; 118/264

[58] Field of Search ..... 156/459, 442.1, 441.5; 15/169; 118/109, 264, 265, 266, 267, 268, 503, 253, 40–43

[56] References Cited

U.S. PATENT DOCUMENTS

| | | | |
|---|---|---|---|
| 1,476,817 | 12/1923 | Hatfield | 118/503 |
| 1,962,722 | 6/1934 | Kreuger | 118/264 X |
| 2,095,038 | 9/1933 | Ragot | 118/264 X |
| 3,348,524 | 10/1967 | Butler | 118/43 |
| 3,710,759 | 1/1973 | Tardoskegyi et al. | 118/123 |

*Primary Examiner*—John P. McIntosh
*Assistant Examiner*—Mary Beth Calligaris
*Attorney, Agent, or Firm*—Donald P. Walker; William D. Soltow, Jr.; Albert W. Scribner

[57] ABSTRACT

In a machine which includes framework and apparatus for dispensing a moistenable workpiece, there is provided workpiece moistening instrumentalities. The workpiece moistening instrumentalities include: a source of supply of moistening fluid which has an upper end and a lower end, the lower end being pivotably attached to the framework; structure for moving the upper end of the supply source between a first position, wherein the supply source is inaccessibly disposed, and a second position wherein the supply source is accessibly disposed; and, applicator structure removably mountable in the supply source. Preferably, the applicator structure includes a brush and a housing for the brush, the brush includes bristles, the housing includes a plurality of teeth, and the brush includes a plurality of teeth for engagement with the housing's teeth for locating the brush at different levels within the housing, such that the brush bristles may be relocated relative to the upper end of the housing when the bristles become worn.

8 Claims, 11 Drawing Figures

Fig. 8.
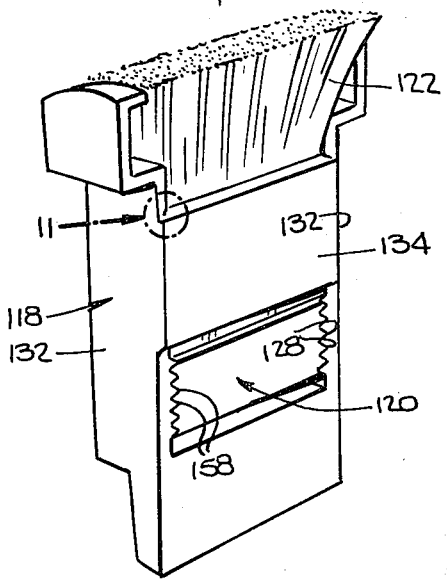
Fig. 9.
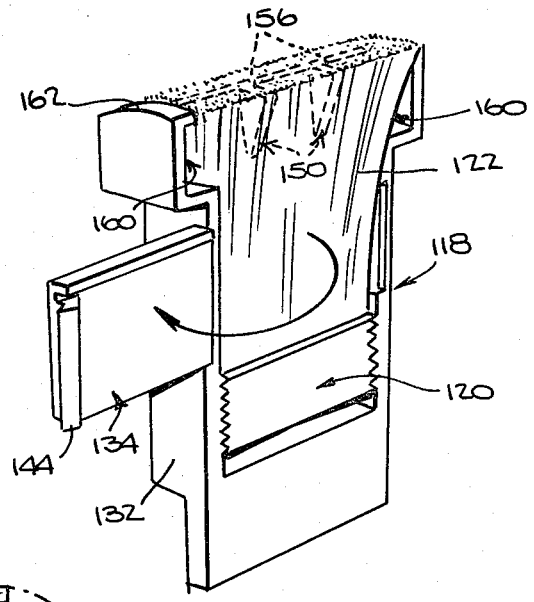
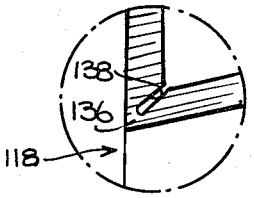
Fig. 11.
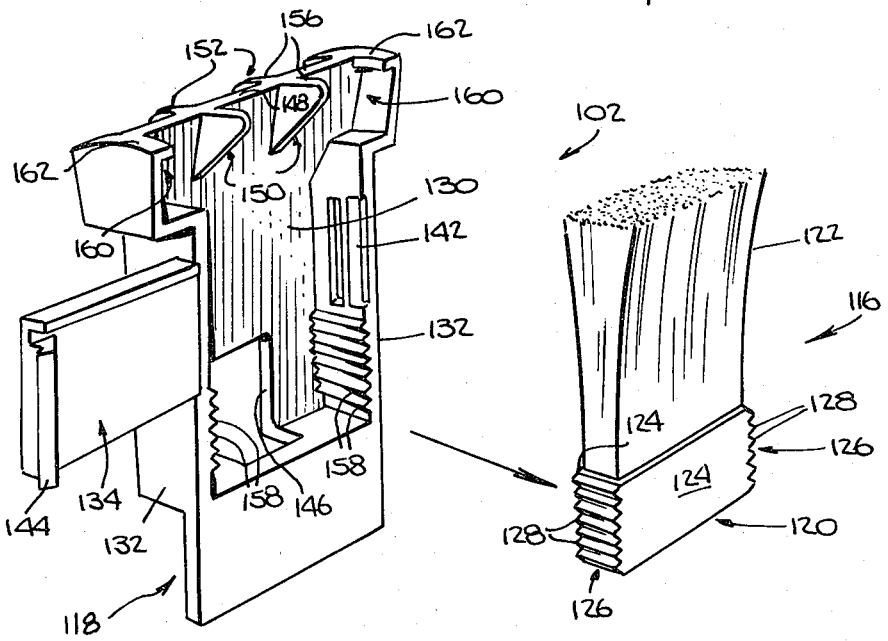
Fig. 10.

WORKPIECE MOISTENING SYSTEM

BACKGROUND OF THE INVENTION

This Application is related to U.S. patent application Ser. No. 322,626 of Robert R. Reid et al for Workpiece Moistening Apparatus, filed concurrently herewith and assigned to the assignee of the present invention.

As shown in U.S. Pat. No. 2,970,536, for Postage Meter Machines, issued Feb. 7, 1961 to J. W. Bach and assigned to the assignee of the present invention, commercially available mailing machines of the type which include conventional means for feeding a moistenable workpiece, such as a strip of adhesive bearing material, in a predetermined path of travel through an imprinting station, cutting station and dispensing station, are generally provided with workpiece moistening means at the dispensing station for moistening the workpiece as it is dispensed. As disclosed in the aforesaid U.S. Patent it is known in the art to provide strip moistening structure, having a water tank, which is removably hingedly mounted on the machine for pivoting about a vertical axis so that it can be swung outwardly from the confines of the machine and removed for servicing and cleaning purposes. Although accessing the strip moistening structure for replenishing the water supply is a task that can be easily handled by customers, it has been found that customers rarely if ever clean and service the structure. And if the customers do so they experience difficulties in the course of disassembling, cleaning, adjusting and/or reassembling the structure. As a consequence, customers generally call in factory trained technical personnel for handling this task, with the result that the customers incur costs which could be avoided if the strip moistening structure were not only readily accessible but also readily dissassembled, cleaned, adjusted and reassembled without the use of tools. Accordingly:

an object of the invention is to provide an improved workpiece moistening system which can be easily serviced by customers without the use of tools;

another object is to provide improved strip moistening means for use in a mailing machine having means for feeding a moistenable strip of adhesive bearing material to a dispensing station at which the strip moistening means is located;

another object is to provide workpiece moistening means constructed and arranged for facilitating disassembly, cleaning, adjustment and reassembly without the use of tools;

another object is to provide improved workpiece moistening structure for a mailing machine, including means for carrying a moisture applicator such that the applicator is readily accessible for servicing; and another object is to provide improved workpiece moistening apparatus for a mailing machine, including improved means for applying moisture to a workpiece.

SUMMARY OF THE INVENTION

In a machine including framework and means for dispensing a moistenable workpiece, there is provided workpiece moistening means. The workpiece moistening means includes: a source of supply of moistening fluid which has an upper end and a lower end, the lower end being pivotably attached to the framework; means for pivoting the upper end of the supply source between a first position, wherein the supply source is inaccessibly disposed, and a second position wherein the supply source is accessibly disposed; and, applicator means removably mountable in the supply source. Preferably, the applicator means includes a brush and a housing for the brush, the brush includes bristles, the housing includes a plurality of teeth, and the brush includes a plurality of teeth for engagement with the housing's teeth for locating the brush at different levels within the housing such that the brush bristles may be relocated relative to the upper end of the housing when the bristles become worn.

BRIEF DESCRIPTION OF THE DRAWINGS

As shown in the drawings wherein like reference numerals designate like or corresponding parts throughout the several views:

FIG. 6 is a fragmentary, exploded view of FIG. 3, showing a prior art moisture applicator being removed from the applicator carrying means according to the invention;

FIG. 9 is a perspective view of the applicator means of FIG. 8, showing the housing thereof open for accessing the brush of the applicator means;

FIG. 10 is an exploded perspective view of the applicator means of FIG. 8, showing the internal structure of the housing of the applicator means and the details of the brush structure of the applicator means; and FIG. 11 is a fragmentary view of FIG. 8, showing details of the hinge portion of the brush housing according to the invention.

DESCRIPTION OF THE PREFERRED EMBODIMENTS

Figure 1:
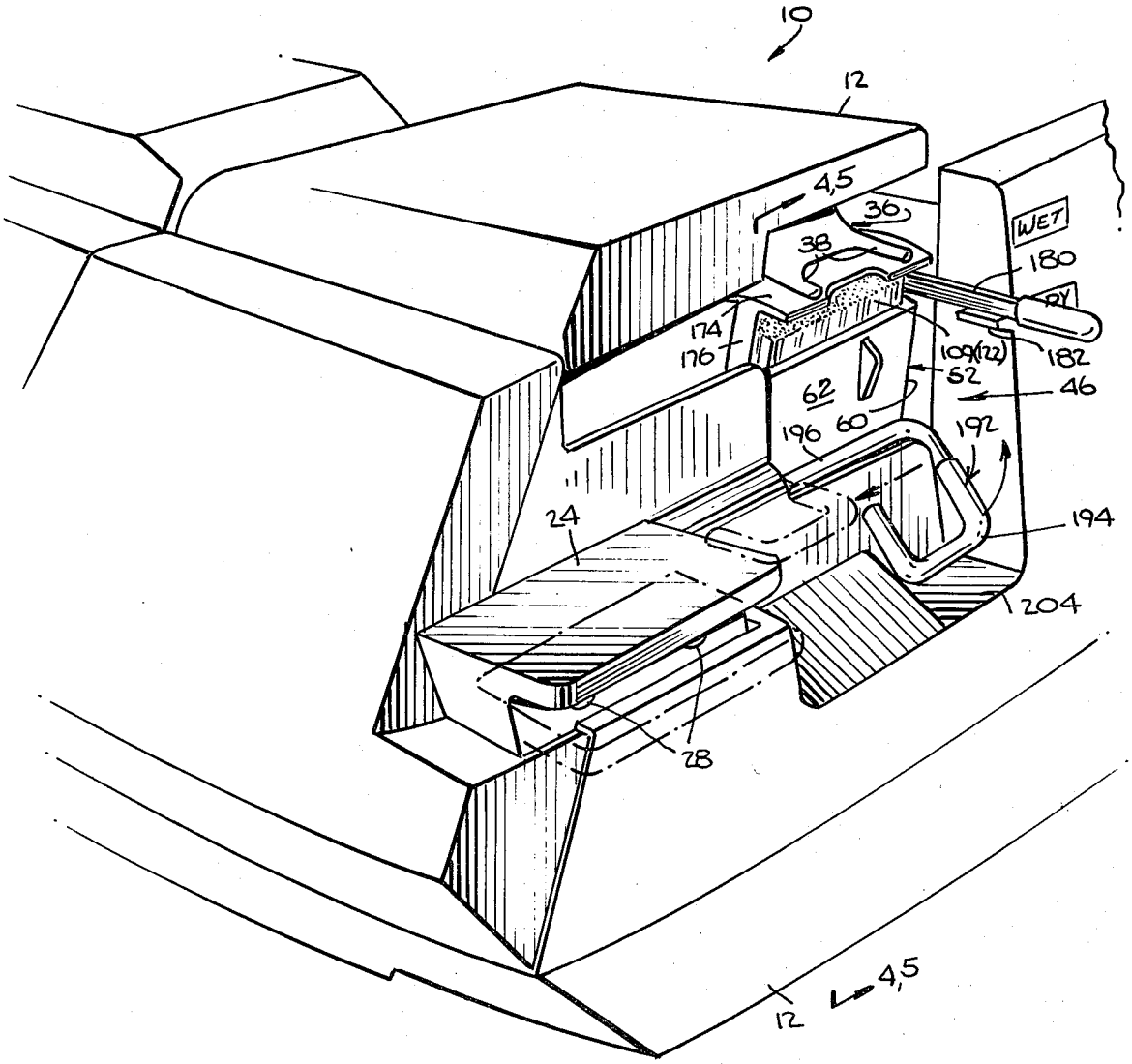
FIG. 1 is a fragmentary, perspective view of a mailing machine which has been modified to include the strip moistening means and associated structure in accordance with the invention.

As shown in FIG. 1, a mailing machine 10 of the type which may be modified in accordance with the invention generally includes a casing 12, and framework 14 (FIG. 2) for supporting the various components of the machine 10, including the casing 12. The machine 10 includes conventional workpiece dispensing means 16 for feeding a moistenable workpiece 18, such as a strip of adhesive bearing material, in a predetermined path of travel 20 to a workpiece dispensing station 22, where the workpiece 18 is moistened prior to being dispensed.

The machine 10 (FIG. 1) includes a relatively large, manually movable, machine-cycle actuator 24, which is conventionally removably fixedly attached to a lever arm 26 (FIG. 2), as by means of suitable fasteners 28. The lever arm 26 is suitably pivotably attached to the framework 14, as by means of a pivot pin 30. The machine 10 also includes a spring 32, which is suitably connected to the lever arm 26 and to the framework 14 for upwardly urging the actuator 24. In addition, the lever arm 26 is conventionally connected to the workpiece dispensing means 16 for enabling the workpiece dispensing means 16 when the actuator 24 is depressed against the force exerted on the arm 26 by the spring 32. When the actuator 24 is depressed, the workpiece dispensing means 16 feeds a workpiece 18 downstream in the path of travel 20 beneath a workpiece depressor member 36. The depressor member 36 is a generally flat, rectangularly-shaped plate having a pair of downstream-extending, parallel-spaced, finger portions 38 and a pair of oppositely laterally-extending workpiece channeling portions 40. The upstream end of the depressor member 36 is conventionally pivotably attached to the machine's framework 14, as by means of a pivot pin 42. The machine 10 also includes a conventional spring 44 which is disposed in engagement with the framework 44, pin 42 and depressor member 36, for urging the depressor member 36, and thus the workpiece 18 fed therebeneath, in a predetermined, downwardly-extending direction toward the workpiece moistening structure 46. The machine 10 further includes a conventional replenishing fluid supply source 48, and includes a flexible tube 50 for connecting the replenishing fluid supply source 48 in fluid flow communication with the workpiece moistening structure 46.

Figure 2:
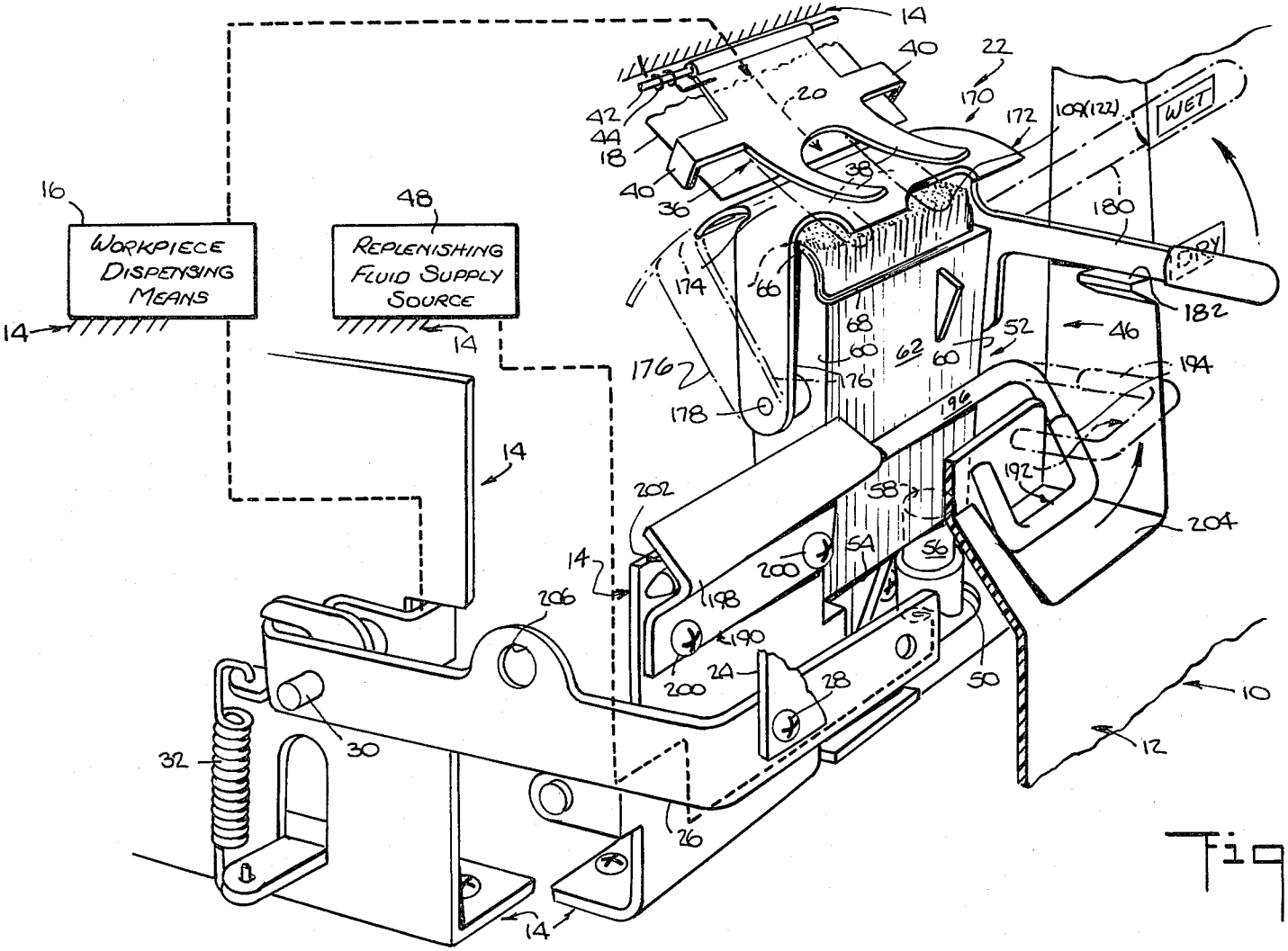
FIG. 2 is a fragmentary view, partially schematic and partially in section, of FIG. 1, showing the casing of the mailing machine removed and showing the details of the cooperative relationship between the strip moistening means and associated structure according to the invention.
Figure 3:
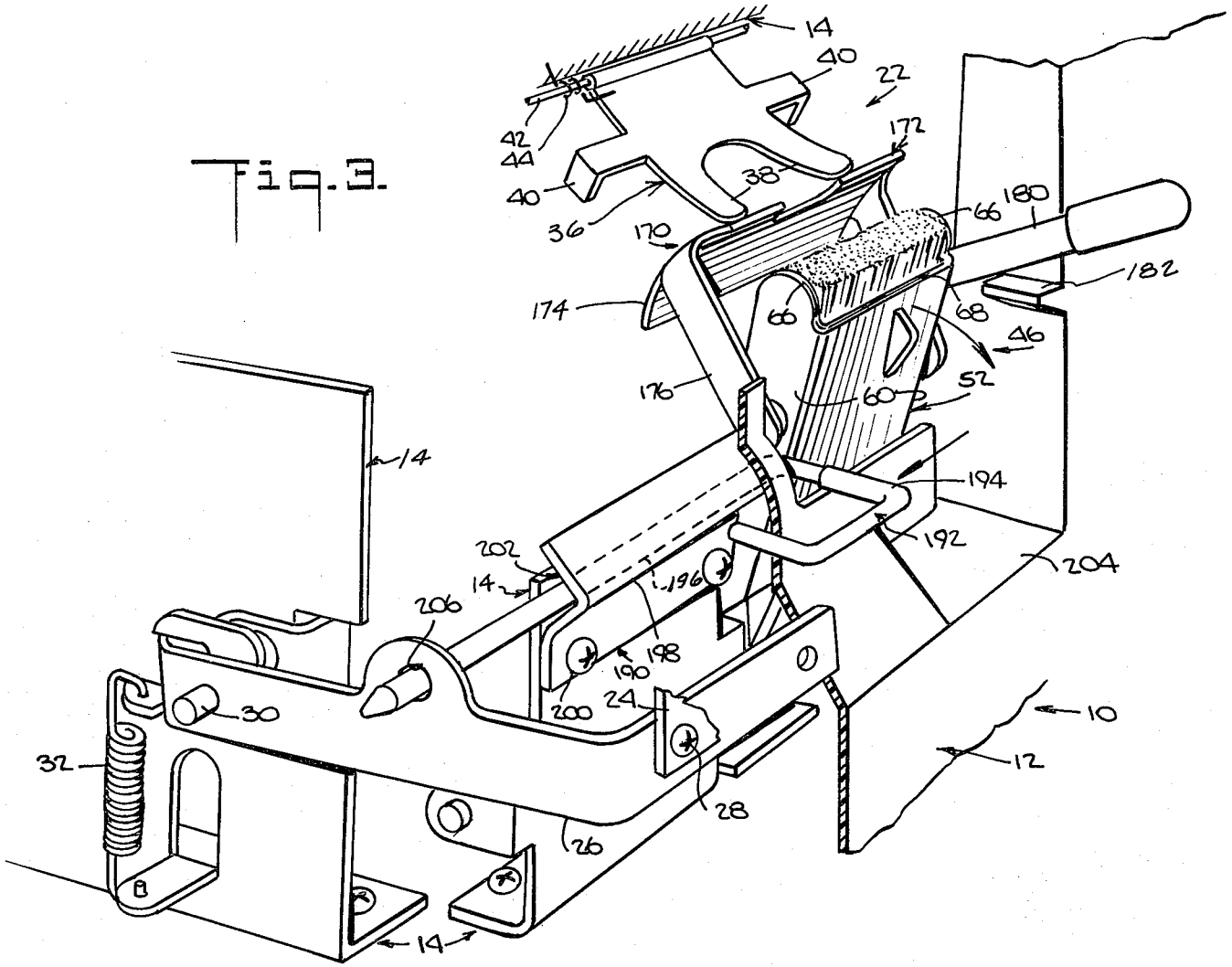
FIG. 3 is a fragmentary view of FIG. 2, showing the manner in which the strip moistening means is enabled for accessing the strip moistening means.

According to the invention there is provided workpiece moistening system 46 (FIG. 2) which includes a moistening fluid supply source. The moistening fluid supply source is an upright receptable 52 having a base wall 54 (FIG. 4) which has integrally formed therewith a solid, depending, leg 55 and a hollow, depending, nipple 56 (FIG. 2). The nipple 56 is provided for connecting the receptacle 52 in fluid flow communication with the tube 50 from the replenishing fluid supply source 48. The nipple 56 forms an opening 58 in the base wall 54 for the ingress of fluid into the receptacle 52 from the tube 50, which is conventionally removably sealed to the nipple 56. In addition, the receptable 52 includes oppositely-spaced, upright, side walls 60, an upright front wall 62 (FIG. 4) and, oppositely spaced from the front wall 62, a rear wall 64. The walls 60, 62 and 64, are integrally formed with the base wall 54, to define an elongate retangularly-shaped receptable 52 for carrying a working supply of workpiece moistening fluid. Preferably, the upper end edges 66 of the side walls 60 extend above the upper end edges, 68 and 70, of the respective front and rear walls, 62 and 64, and are downwardly convexly curved towards the front and rear walls, 62 and 64, for guiding workpieces 18 away from the interior of the receptacle 52.

Figure 4:
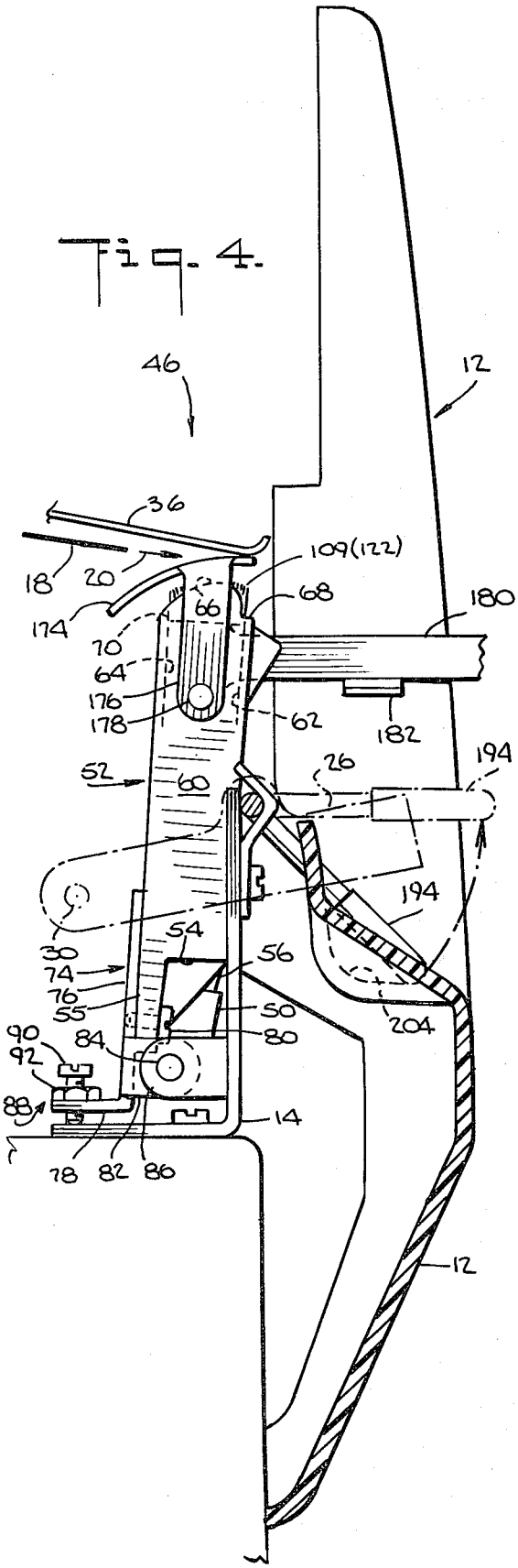
FIG. 4 is a fragmentary, sectional view of FIG. 1, taken substantially along the line 4—4 of FIG. 1.

For pivotally attaching the receptacle 52 (FIG. 4) to the framework 14, the workpiece moistening system 46 includes an L-shaped support 74 which has an upright leg portion 76 and a rearwardly-extending base leg portion 78. The support 74 is conventionally fixedly attached to the receptacle 52, as by means of a fastener 80 which threadably engages the receptacle's base leg 55 and the support 74. The upright leg portion 76 has integrally formed therewith a forwardly-extending bracket 82 which is conventionally removably pivotably attached to the framework 14, as by means of a pivot pin 84 which extends from a supporting bracket 86 of the framework 14. For properly adjusting the position of the receptacle 52 relative to the workpiece's path of travel 20, the moistening system 46 includes a conventional adjustable stop 88, including a screw 90 and an associated lock nut 92. The screw 90 threadably engages and extends downwardly through the support's base leg 78 for abuttment against a horizontally extending portion framework 14. As shown in FIG. 4, the upper end of the receptacle 52 is located slightly forwardly of its lower end due to the stop 88 having been adjusted for appropriately orienting the upper end of the receptacle 52 relative to the workpiece's path of travel 20.

Figure 7:
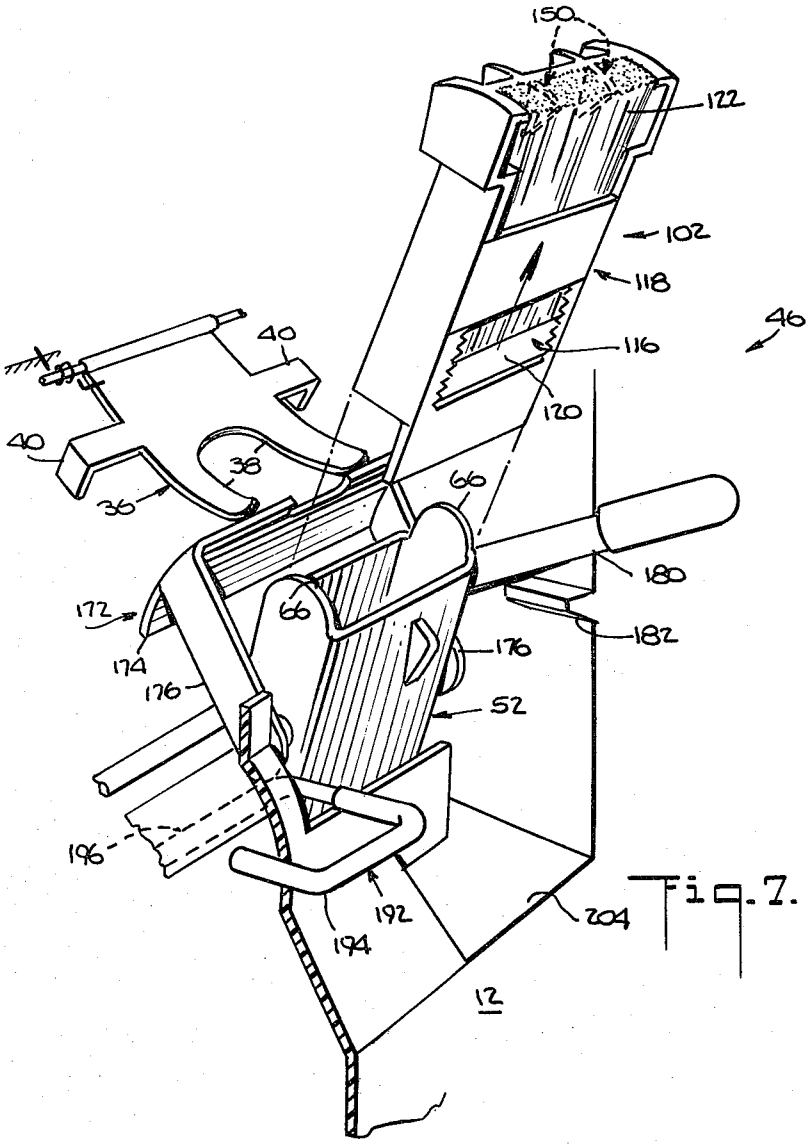
FIG. 7 is a fragmentary view of FIG. 3, showing the moisture applicator means according to the invention being removed from the carrying means according to the invention.

According to the invention, the receptacle 52 is dimensioned for carrying either a prior art moisture applicator 100 (FIG. 6) or a moisture applicator 102 (FIG. 7) in accordance with the invention.

The prior art applicator 100 (FIG. 6) includes an elongate brush 104. The brush 104 includes a base 106 having integrally formed therewith a bracket portion 108. The brush 104 also incudes a moisture carrier in the form of a plurality of bristles 109 which are held in place by the base 106. In addition, the applicator 100 includes a housing 110 for carrying the brush 104. The housing 110 includes an elongate front wall 111 and, integrally formed therewith, a pair of rearwardly-extending, oppositely-spaced, side walls 112. Each of the side walls 112 has formed therein a longitudinally-extending slot 114. Each of the slots 114 is dimensioned for receiving a screw 116. The screw 116 conventionally threadably engages the brush's bracket portion 108 and slidably engages the associated side wall 112, to allow for adjustably raising and lowering the brush bristles 109 relative to the upper end of the housing 110, for properly positioning the free ends of the brush bristles 109 relative to the receptacle's upper end edges 66 when the applicator 100 is mounted within the receptable 52. With this arrangement, a screwdriver is needed for positioning the applicator 100 within the housing 110. And, since the position of the brush bristles 109 relative to the upper end edges 66 of the receptacle 52 cannot be checked until the applicator 100 is mounted in the receptacle 52, the applicator 100 may have to be removed from the receptacle 52 for readjusting the position of the brush bristles 109 within the housing 110. Upon remounting, if the readjusted bristles 109 are still not properly located relative to the receptacle's edges 66, the foregoing procedure is ordinarily repeated as many times as is necessary for properly aligning the free ends of the brush bristles with 110 respect to with the receptacle's upper end edges 66.

Figure 8:
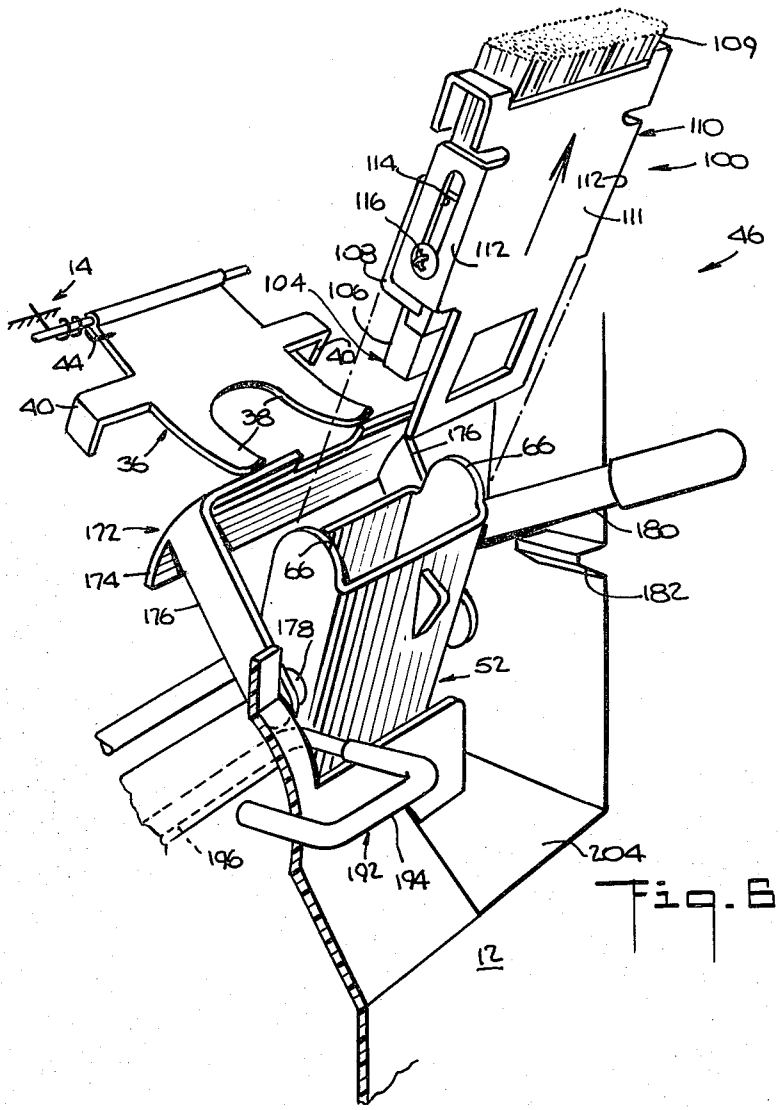
FIG. 8 is a perspective view of the applicator means according to the invention.

The moisture applicator 102 (FIG. 7) according to the invention include an elongate brush 116 and a brush holder in the form of a housing 118. The brush 116 includes a base 120, which is preferably made of a resilient plastic material, such as polypropylene, and includes a moisture carrier which is preferably a plurality of bristles 122 which are held in place by the base 120. The brush base 120 (FIG. 10) has oppositely-spaced front and rear walls 124 and oppositely-spaced side walls 126. Each of the side walls 126 has formed therein a plurality of parallel-spaced teeth 128. The housing 118, which is preferably made of a resilient plastic material, such as polypropylene, includes a rear wall 130, oppositely-spaced side walls 132 and a front wall 134 (FIG. 8). The front wall 134 preferably comprises a door which is integrally hingedly attached to one of the side walls 132 by means of a vertically-extending, flexible, hinge portion 136 (FIG. 11) of the housing 118, at the intersection between the front wall 134 and one of the side walls 132. Preferably, the hinge portion 136 is formed by molding a vertically-extending slot 138 at the aforesaid intersection. With this arrangement, the front wall 134 (FIG. 8) is pivotally movable about a vertical axis defined by the plastic material from which the housing 118 is made. The housing's side wall 132 (FIG. 10) opposite the hinge 140 has formed therein an aperture 142. And, the vertically-extending, free side edge of the front wall 134 has integrally formed therewith a latch portion 144. The latch portion 144 is dimensioned relative to the aperture 142 such that the latch portion 144 is insertable into, and removable from, the aperture 144 against the resilient forces exerted on the latch portion 144 by the walls of the aperture 142. The rear wall 130 has formed therein an opening 146 for fluid flow communication therethrough. In addition, the rear wall 130 has integrally formed therewith a pair of parallel-spaced, forwardly-extending rib portions 150, for guiding workpieces 18 out of the interior of the housing 118, and a pair of parallel-spaced, rearwardly-extending rib portions 152 for guiding workpiece 18 toward the brush bristles 122. In this connection, the upper end edges 156 of the respective rib portions 150 and 152 cooperatively assist in guiding workpieces 18 (FIG. 2) in the path of travel 20. The housing's side walls 132 (FIG. 10) each have integrally formed therewith a plurality of parallel-spaced teeth 158. The teeth 158 are dimensioned for slidable engagement with the brush base's teeth 128 for mounting the brush base 120 (FIG. 9) within the housing 132 at an initial predetermined level and, thereafter, at different predetermined levels as the brush bristles 122 become worn, for renewably locating the free ends of the brush bristles 122 slightly above the upper end edges 156 (FIG. 9) of the guide ribs 150. The front wall 134 (FIG. 8) may then be closed for holding the brush 116 in place within the housing 118. When so mounted, the guide ribs 150 (FIG. 9) are disposed in combing relationship with respect to the brush bristles 122. Accordingly, the ribs 150 prevent workpieces 18 from becoming entangled in the brush bristles 122, due to the upper edges 156 of the ribs 150 guiding workpieces 18 out of entanglement with the bristles 122. Since the various levels that the teeth 128 (FIG. 10) of the brush base 120 may be engaged with the teeth 158 of the housing 118 are predetermined by the spacing between the oppositely disposed housing teeth 158, the brush 116 may be easily adjusted by customers; the guesswork having been taken out of the process of determining the next level to which a worn brush 116 should be elevated for relocating the free ends of the brush's bristles 122. And, such relocation may be accomplished without the use of tools. Further, since either of the brush base side walls 126, may be engaged with either of the housing's side walls 132, the brush 116 may be mounted within the housing 118 such that either of the base walls 124 face the housing's rear wall 130, for preventing the free ends of the brush bristles 122 from becoming unevenly worn.

As shown in FIG. 10, the upper ends of the housing's side walls 132 and the rear wall 130 conjointly define a pair of oppositely facing cavities 160 for confining the laterally flaring upper ends of adjacent brush bristles 122 (FIG. 9) within the housing 118, and directing drainage from such flared bristles 122 towards the interior of the housing 118. And, due to the upper end edges 162 of the side walls 132 extending substantially parallel to the upper end edges 156 of the ribs, 150 and 152, the edges 162 cooperate with the ribs 150 for guiding workpieces 18 toward and into engagement with the free ends of the brush bristles 122.

Figure 5:
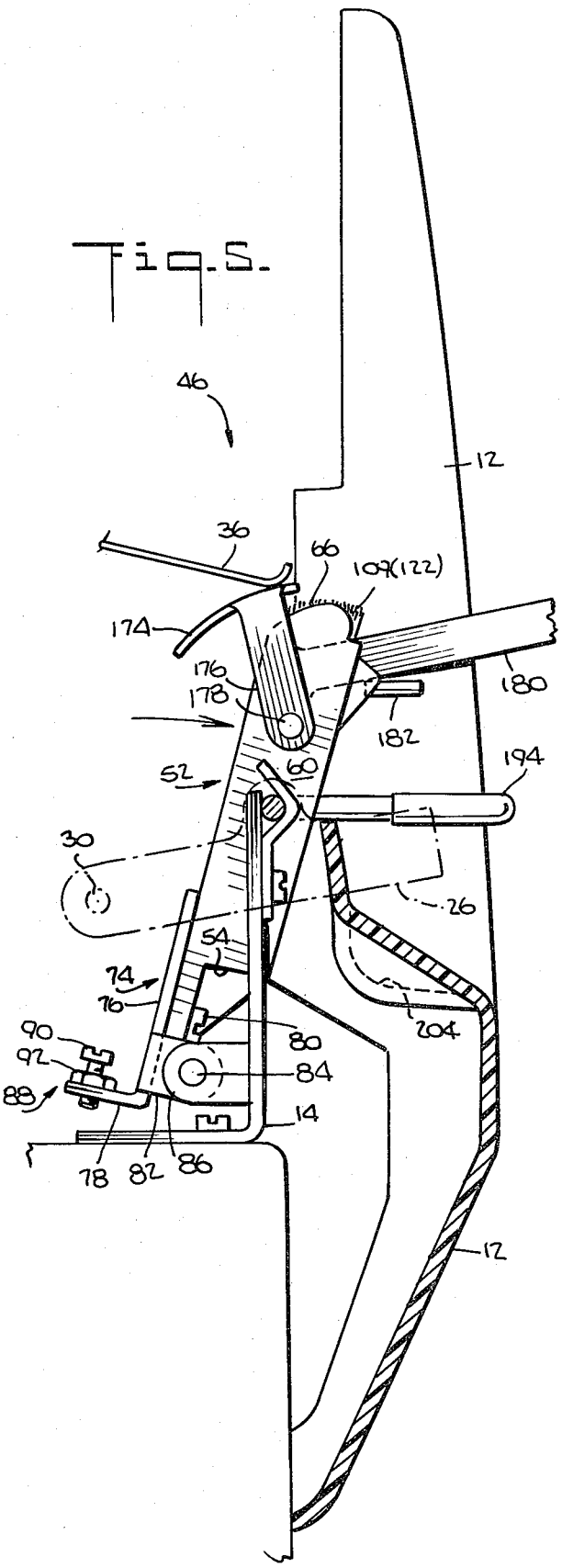
FIG. 5 is a fragmentary, sectional view of FIG. 1, taken substantially along the line of 5—5 of FIG. 1.

According to the invention, the workpiece moistening system 46 (FIG. 2) additionally includes means 170 cooperative with the workpiece depressor structure 22 for controlling the position of the workpiece depressor member 36. The position controlling means 170 includes an inverted U-shaped member 172, having a plate portion 174 and oppositely-spaced depending portions 176. The plate portion 174 is an elongate, generally rectangularly shaped member which is downwardly convexly curved in transverse cross-section. The depending leg portions 176 extend downwardly from the opposite ends of the plate portion 174 and are pivotally attached on a one for one basis, as by means of pivot pins 178, to the receptacle's side wall 60. In addition, the depressor member controlling means 170 includes an arm portion 180 which extends outwardly from the confines of the machine's casing 12 for manually pivoting the member 172 into and out of engagement with the depressor member 36. When the receptable 52 and thus the applicator, 100 or 102, is disposed in its working position, as shown in FIGS. 2, the arm portion 180 is manually movable between a "dry" position and a "wet" position. In the dry position, the plate portion 174 is disposed between the applicator brush bristles, 109 or 122, and depressor member 36; with the result that as each workpiece 18 is dispensed by the machine 10, the workpiece 18 is guided by the plate portion 174 beneath the depressor member 36, which urges the workpiece 18 into engagement with the upper surface of the plate portion 174. Accordingly, when the arm portion 180 is disposed in the dry position, the plate portion 174 shields the workpiece 18 from engagement with the applicator brush bristles, 109 or 122, with the result that a dry workpiece 18 is dispensed from the machine 10. In the wet position, the plate portion 174 is located in a position which is rearwardly of the receptable 52 and out of engagement with the depressor member 36; with the result that as a workpiece 18 is dispensed by the machine 10, the workpiece 18 is either guided by the upper end edges 66 of the receptacle side walls 66, in the case of usage of the applicator 100, or guided by the applicator housing 118, in the case of usage of the applicator 102, beneath the depressor member 36. Whereupon the depressor member 36 urges the workpiece 18 into engagement with the brush bristles, 109 or 122, as the case may be. Accordingly, when the arm portion 180 is disposed in the wet position, the plate portion 174 does not shield the workpiece 18 from engagement with the applicator brush bristles, 109 or 122, with the result that a wet workpiece is dispensed from the machine 10. Assuming the arm portion 180 is disposed in either the wet or dry position, the receptable 52 may be manually moved from within the confines of the machine 10 (FIG. 5), by pulling the lever arm portion 180 outwardly of the machine 10. As the arm portion 180 is pulled, it normally engages a stop 182 and is cammed upwardly thereby for disposing the plate portion 174 in engagement with, and in supporting relationship with resepct to, the depressor member 36 against the force exerted on the depressor member 36 by the spring 44. As a result, the spring 44 is prevented from urging the depressor member 36 downwardly behind the receptable 52.

According to the invention, the workpiece moistening system 46 (FIG. 2) additionally includes structure which is cooperative with the lever arm 26 for disabling access to the housing 52 and moisture applicator, 100 or 102, until the workpiece dispensing means 16 is disabled. To that end, the system 46 is provided with latching structure including a bracket 190 and a latch 192. The latch 192 includes a handle portion 194 and an elongate rod portion 196 which extends from the handle portion 194. The bracket 190 is an elongate, rectangularly-shaped plate which has formed therein a longitudinally-extending bend 198. The bracket in 190 is conventionally fixedly attached to the framework 14, as by means of screws 200, such that the bend 198 is offset from a portion of the framework 14 which, in conjunction with the bend 198, forms a passageway 202. The latch's rod portion 196 is slidably and pivotably mounted within the passageway 202. In addition, the machine's casing 12 has formed therein a channel 204 which is located forwardly of the receptable 52 and is dimensioned for removably containing the latch's handle portion 194. And the lever arm 26, to which the machine-cycle actuator 24 is attached, is provided with an aperture 206 which is dimensioned for slidably receiving the latch's rod portion 196.

When the latch's handle portion 194 is contained within the channel 204, the rod portion 196 is located for blocking pivotal movement of the receptacle 52. In addition, the rod portion 196 is located and out of engagement with the lever arm's aperture 206. When the latch 192 is so positioned, the machine cycle actuator 24 may be depressed for moving the lever arm 26 downwardly, thereby enabling the workpiece dispensing means 16.

When the latch's handle portion 194 is pivotly moved upwardly and out of the channel 204, the handle portion 194 is movable to the left, for slidably moving the rod portion 196 to the left within the passageway 202, out of blocking relationship with respect to the receptable 52 and into the lever arm's aperture 206. When the latch 192 is so positioned, the machine cycle actuator 24 cannot be depressed to move the lever arm 26 downwardly, as a result of which the workpiece dispensing means 16 is disabled. And, concurrently, since the rod portion 196 no longer blocks pivotal movement of the receptacle 52, access to the receptable 52 is enabled as a result of which the receptacle 52 may be moved outwardly of the confines of the machine 10 as hereinbefore discussed.

In accordance with the objects of the invention, there has been described an improvement in a workpiece moistening system which can be easily serviced by customers without the use of tools.

Inasmuch as certain changes may be made in the above described invention without departing from the spirit and scope of the same, it is intended that all matter contained the above description or shown in the accompanying drawings shall be interpreted in an illustrative rather than limiting sense. And, it is intended that the following claims be interpreted to cover all the generic and specific features of the invention herein described.

What is claimed is:

1. In a machine including framework and means for dispensing a moistenable workpiece, improved workpiece moistening means comprising:

a. a source of supply of moistening fluid, said supply having an upper end and a lower end, means for pivotably attaching the lower end of said supply source to said framework;

b. means for moving the upper end of said supply source between a first position wherein said supply source is inaccessibly disposed and a second position wherein said supply source is accessibly disposed;

c. applicator means removably mountable in said supply source; and d. means for disabling said moving means until said workpiece dispensing means is disabled.

2. The improvement according to claim 1, wherein said supply source includes means for connecting said supply source in fluid flow communcation with a replenishing source of supply of fluid.

3. In a machine including framework and means for dispensing a moistenable workpiece, improved workpiece moistening means comprising:

a. a source of supply of moistening fluid, said supply having an upper end and a lower end, means for pivotably attaching the lower end of said supply source to said framework;

b. means for moving the upper end of said supply source between a first position wherein said supply source is inaccessibly disposed and a second position wherein said supply source is accessibly disposed;

c. applicator means removably mountable in said supply source; and d. means for concurrently disabling said workpiece dispensing means and enabling said moving means.

4. In a machine including framework and means for dispensing a moistenable workpiece, improved workpiece moistening means comprising:

a. a source of supply of moistening fluid, said supply having an upper end and a lower end, means for pivotably attaching the lower end of said supply source to said framework;

b. means for moving the upper end of said supply source between a first position wherein said supply source is inaccessibly disposed and a second position wherein said supply source is accessibly disposed;

c. applicator means removably mountable in said supply source; and d. said machine including means for urging said workpiece in a predetermined direction, said workpiece moistening means including means movably attached to said supply source for supporting said workpiece urging means, said supporting means pivotably attached to said supply source for movement to a first position for enabling said workpiece urging means when said supply source is inaccessibly disposed and to a second position for disabling said workpiece urging means when said supply source is accessibly disposed.

5. In a machine including framework and means for dispensing a moistenable workpiece, improved workpiece moistening means comprising:

a. a source of supply of moistening fluid, said supply having an upper end and a lower end, means for pivotably attaching the lower end of said supply source to said framework;

b. means for moving the upper end of said supply source between a first position wherein said supply source is inaccessibly disposed and a second position wherein said supply source is accessibly disposed;

c. applicator means removably mountable in said supply source; and d. said applicator means including a plurality of workpiece deflecting ribs located at spaced intervals along the upper end of said applicator means.

6. In a machine including framework and means for dispensing a moistenable workpiece, improved workpiece moistening means comprising:

a. a source of supply of moistening fluid, said supply having an upper end and a lower end, means for pivotably attaching the lower end of said supply source to said framework;

b. means for moving the upper end of said supply source between a first position wherein said supply source is inaccessibly disposed and a second position wherein said supply source is accessibly disposed;

c. applicator means removably mountable in said supply source; and d. said applicator means including a brush having bristles, and said applicator means including a plurality of workpiece deflecting ribs respectively normally disposed in combing relationship with respect to said brush bristles.

7. In a machine including framework and means for dispensing a moistenable workpiece, improved workpiece moistening means comprising:

a. a source of supply of moistening fluid, said supply having an upper end and a lower end, means for pivotably attaching the lower end of said supply source to said framework;

b. means for moving the upper end of said supply source between a first position wherein said supply source is inaccessibly disposed and a second position wherein said supply source is accessibly disposed;

c. applicator means removably mountable in said supply source; and d. said applicator means including a brush and a housing for said brush, said brush including a base for holding said brush bristles, said housing including a first plurality of teeth, and said brush base including a second plurality of teeth slidably separably engageable with said first plurality of teeth for locating said brush base on different predetermined levels within said housing whereby said brush bristles may be relocated relative to the upper end of said housing when said brush bristles become worn.

8. In a machine including framework and means for dispensing a moistenable workpiece, improved workpeice moistening means comprising:

a. a source of supply of moistening fluid, said supply having an upper end and a lower end, means for pivotably attaching the lower end of said supply source to said framework;

b. means for moving the upper end of said supply source between a first position wherein said supply source is inaccessibly disposed and a second position wherein said supply source is accessibly disposed; and c. applicator means removably mountable in said supply source, said applicator means including a brush having bristles, said applicator means including a housing within which said brush may be mounted, and said housing including a plurality of workpiece deflecting ribs disposed in combining relationship with respect to said brush bristles when said brush is mounted within said housing.

* * * * *